US005556066A

United States Patent [19]

Negishi

[11] Patent Number: 5,556,066

[45] Date of Patent: Sep. 17, 1996

[54] INSTALLATION STRUCTURE OF OUTDOOR COMMUNICATION DEVICE

[75] Inventor: Masayuki Negishi, Tokyo, Japan

[73] Assignee: NEC Corporation, Tokyo, Japan

[21] Appl. No.: 329,269

[22] Filed: Oct. 26, 1994

[51] Int. Cl.[6] ..... F21V 21/00

[52] U.S. Cl. ..... 248/218.4; 439/929; 439/297; 343/720; 362/431

[58] Field of Search ..... 248/218.4, 121, 248/187, 158; 362/431, 153.1, 410; D26/67, 68, 93, 71; D25/126, 127, 132; 343/870, 721, 720, 890; 439/929, 296, 297, 298

[56] References Cited

U.S. PATENT DOCUMENTS

| | | | |
|---|---|---|---|
| 350,046 | 9/1886 | Doubleday et al. | 362/431 |
| 3,187,175 | 6/1965 | Lang | 362/431 |
| 3,225,224 | 12/1965 | Rydbeck | 362/431 |
| 3,521,413 | 7/1970 | Scott et al. | 248/158 |
| 3,552,073 | 1/1971 | Millerbernd | 248/158 |
| 3,862,411 | 1/1975 | Persson | 362/431 |
| 4,085,318 | 4/1978 | Odle et al. | D26/71 |
| 4,878,160 | 10/1989 | Reneau et al. | 362/43.1 |
| 5,161,874 | 11/1992 | Benes | 362/431 |

FOREIGN PATENT DOCUMENTS

| | | |
|---|---|---|
| 20580505A1 | 1/1994 | European Pat. Off. . |
| 2-184206 | 7/1990 | Japan . |

OTHER PUBLICATIONS

*Patent Abstracts of Japan,* vol. 18, No. 280 (E-1555), 27 May 1994 & JP-A-06 053894 (Nippon Steel) published 25 Feb. 1994.

*Patent Abstracts of Japan,* vol. 17, No. 6 (E-1302), 7 Jan. 1993 & JP-A-04 238424 (Nippon Telegraph & Telephone) published 26 Aug. 1992.

*Patent Abstracts of Japan,* vol. 15, No. 94 (E-1041), 6 Mar. 1991 & JP-A-02 305075 (Toshiba) published 18 Dec. 1990.

*Primary Examiner*—Karen J. Chotkowski
*Assistant Examiner*—Anita M. King
*Attorney, Agent, or Firm*—Foley & Lardner

[57] ABSTRACT

A mounting pole 2*a* is independently installed in a place such as a park or a road where the beauty of the environment is an important factor. The mounting pole 2*a* has a communication mounting part 9*a* on the top thereof. A communication device 1*a* for outdoor use has an antenna 3*a* directly fixed on the top thereof and removably fitted in a groove of the device mounting part 9*a*. The device 1*a* has a connector 7*a* and no wiring thereof is exposed to the outside. The device 1*a* is electrically connected with the outside device through the connector 7*a*. In the mounting part 9*a* of the mounting pole 2*a*, there is provided a connector 8*a* at a position suitable for connection with the connector 7*a* in fitting engagement relationship. Wirings 10*a* interconnecting the connector 8*a* and the outside device are all laid through the interior of the mounting pole 2*a*. Consequently, none of the wirings 10*a* is exposed to the outside.

4 Claims, 6 Drawing Sheets

INSTALLATION STRUCTURE OF OUTDOOR COMMUNICATION DEVICE

BACKGROUND OF THE INVENTION

1. Field of the Invention

The present invention relates to an installation structure of an outdoor communication device, and more particularly to an installation structure of an outdoor communication device having excellent maintainability and a fine exterior view which is fit to be installed in a place where a beautiful appearance is required as an important factor, such as a public spot or a concept town which is constructed according to a well prepared plan and is highly developed in various aspects.

2. Description of the Related Art

Since an outdoor communication device to be installed outdoors is generally installed in a public place, its exterior view is a matter of importance. Further, in the case that the outdoor communication device is installed in an existing town which has been finely finished as in a concept town, the outdoor communication device needs to have an appearance which agrees with the environment.

Since conventional outdoor communication devices have been installed after the completion of the construction of structures such as buildings, utility poles or telephone poles, priority has been given only to their functions, and hence no consideration has been given to their appearances. For example, according to the conventional installation structure as disclosed in Japanese Patent Laid-open No. 184206/90 and shown in FIG. 1, a communication device 1X is mounted on a base plate 10X by means of screws and fixed to a utility pole or telephone pole 5X by means of a metal fixture 11X provided on the base plate 10X. Or, in some cases, a metal fixture is mounted directly to the communication device, without providing a base plate. A wiring 13X is drawn out of a hole in the outside surface of the communication device 1X and fixed to the utility pole or the telephone pole 5X by a fixing band 12X, the wiring 13X being exposed to the outside.

In the conventional installation structure of the outdoor communication device as described above, since mounting or detaching the communication device on and from the base plate is not easy and the maintainability of the communication device is poor, the communication device cannot be placed on an elevated spot and consequently an antenna which has to be placed in an elevated spot needs to be placed in an elevated spot apart separated from the communication device. As a result, there is a problem that the loss of the communication device becomes larger due to extended length of the wiring laid between the antenna and the outdoor communication device.

Further, the communication devices and mounting poles are designed without paying special attention to their appearances, and hence wirings are all exposed to the outside, often spoiling the beauty of surroundings. Particularly, in a town highly developed in various aspects such as a concept town, wirings are embedded in the ground and there are no utility pole and telephone pole in the town so that the installation space for the communication devices is limited. Therefore, if the communication devices are installed after the town is completed, the beauty of the surroundings will be impaired.

SUMMARY OF THE INVENTION

The present invention has been developed in view of the above problems of the prior art. An object of the present invention is to provide an installation structure of an outdoor communication device which has excellent maintainability and accords with the surroundings.

In order to achieve the above object, according to the present invention, there is provided an outdoor communication device and a mounting pole in the form of a selfsupported pole having a mounting part on the top thereof for mounting the outdoor communication device. The outdoor communication device is connected to an outdoor communication device mounting part of the mounting pole by means of a connector, and wiring is laid through the interior of the mounting pole so as to be connected to the connector.

According to the present invention, another type of a mounting pole has a streetlight unit provided thereon.

Further, according to the present invention, still another type of outdoor communication device and a mounting part for mounting the outdoor communication device are provided and the outdoor communication device is connected to the mounting part by means of a connector and, in addition, the mounting part is provided with a streetlight unit and fixed to a utility pole or a telephone pole.

Furthermore, according to the present invention, yet another type of outdoor communication device and a mounting part for mounting the outdoor communication device are provided and the outdoor communication device is connected to the mounting part through a connector and the mounting part is installed on the top of a telephone booth so as to be integrated thereinto.

In the present invention as described as above, mounting and detaching operation of the outdoor communication device is simplified by connecting the outdoor communication device and the mounting part through the connector, and hence the communication device of the present invention can be of service with excellent maintainability. Being constituted as above, the outdoor communication device of the present invention can be installed in an elevated spot and the antenna can be installed in an elevated spot and the antenna can be directly mounted thereon.

And, according to the present invention, the outdoor communication device is mounted on the top of the mounting pole in the form of a selfsupported pole and wiring is laid through the interior of the mounting pole, and a streetlight unit is provided on the top of the mounting pole to imitate a streetlight, and hence the mounting pole of the present invention can be installed in the street without injuring the beauty of the street, particularly in the street of a concept town which is constructed in a highly developed manner without degrading the beauty of the surrounding area.

Further, even when a space for installing the mounting part cannot be obtained and the mounting part has to be installed on existing facilities, it is possible to attach the mounting part to an existing utility pole or a telephone pole in imitation of a streetlight mounted on the existing pole or to install the mounting part on an existing telephone booth so as to be integrated thereinto, thereby integrating the outdoor communication device into the environment.

DETAILED DESCRIPTION OF THE PREFERRED EMBODIMENTS

An embodiment of the present invention will next be described with reference to the drawings.

Figure 1:
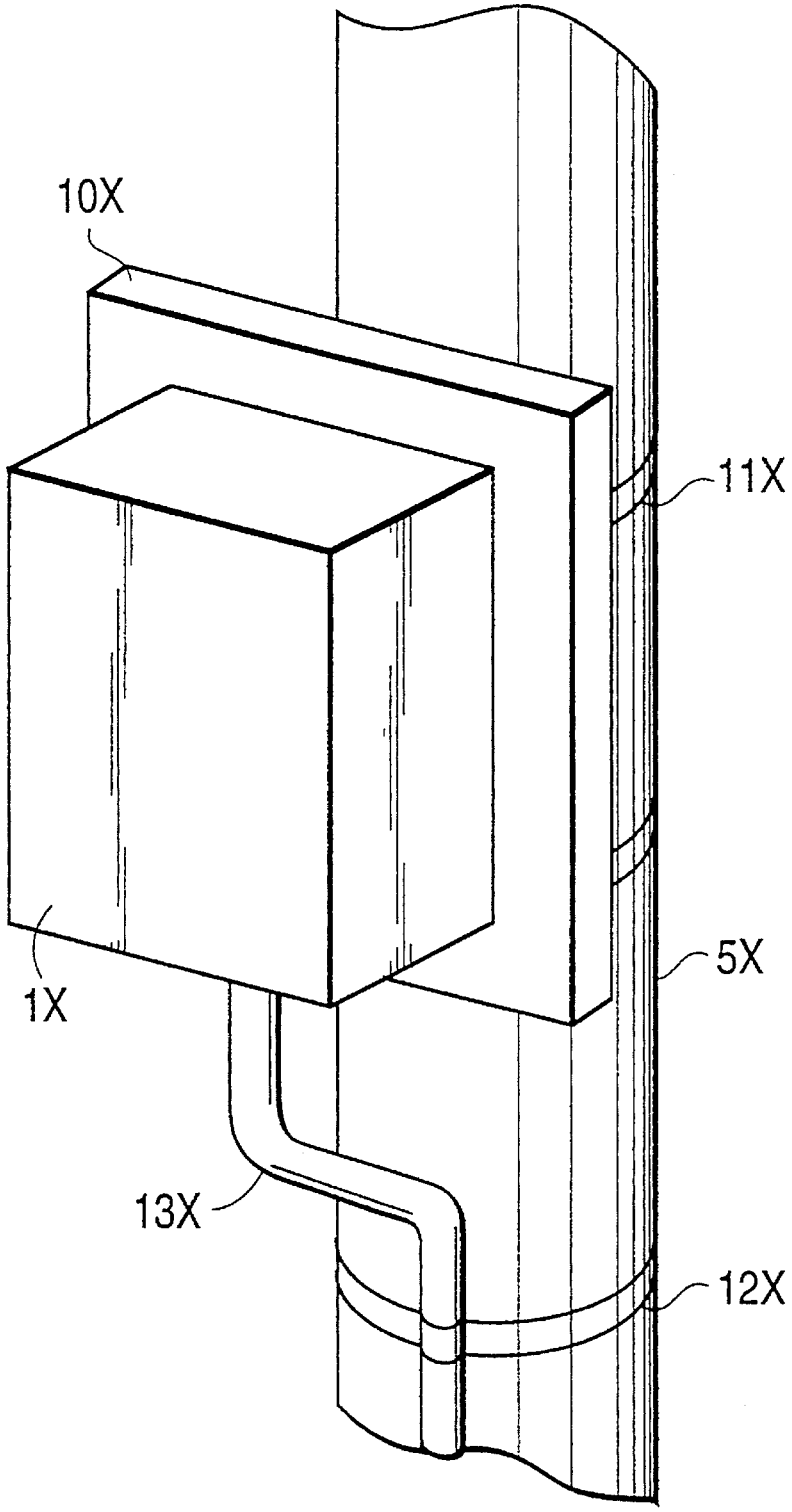
FIG. 1 PRIOR ART
FIG. 1 is a perspective view showing an installation structure of conventional communication device.
Figure 2:
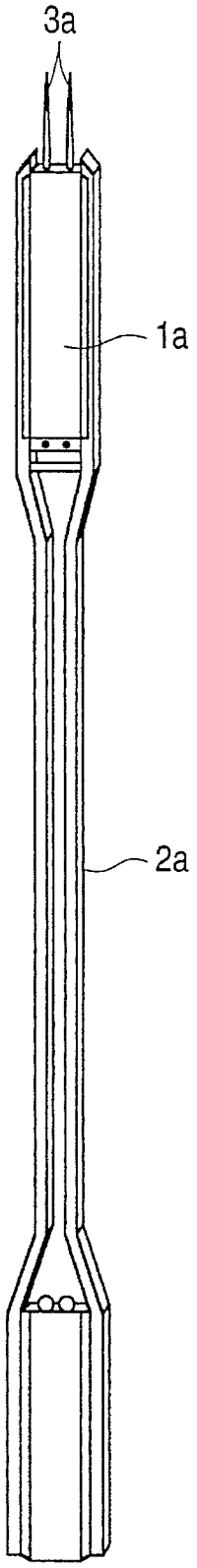
FIG. 2 is a perspective-view showing a first embodiment of an installation structure with reference to outdoor communication device of the present invention.
Figure 3:
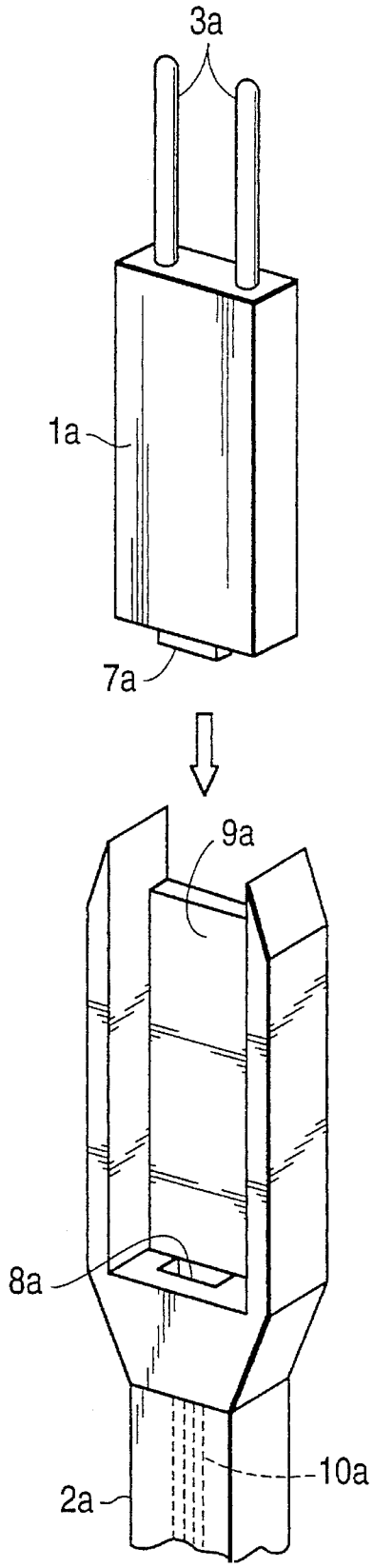
FIG. 3 is an enlarged view showing principal parts of the outdoor communication device of FIG. 1 before it is assembled.

FIG. 2 is a general perspective view showing a first embodiment of an installation structure with respect to an outdoor communication device of the present invention. FIG. 3 is an enlarged view showing the upper part of a mounting pole before the communication device of FIG. 2 is mounted thereon.

As shown in FIG. 2 and FIG. 3, a mounting pole 2*a* is independently installed on a spot in a park or a road where a fine view is an important factor. The mounting pole 2*a* is a hollow pole in the form of an selfsupported pole and is provided with a communication device mounting part 9*a* on the top thereof. Communication device 1*a* for outdoor use is mounted on the communication device mounting part 9*a* of the mounting pole 2*a* by fitting it releasably into the mounting part 9*a*. The mounting pole 2*a* has wiring 10*a* laid from the outside into the interior thereof to connect the wiring 10*a* to the communication device 1*a* through a connector.

In other words, the communication device 1*a* has an antenna 3*a* provided directly on the top thereof, and is mounted by being fitted releasably in a groove of the communication device mounting part 9*a* provided on the top of the mounting pole 2*a*. The communication device 1*a* has a connector 7*a* and is electrically connected with the outside device through the connector 7*a* without exposing any wirings thereof to the outside. On the other hand, in the communication device mounting part 9*a* of the mounting pole 2*a*, there is provided a connector 8*a* at a suitable position so as to be coupled with the connector 7*a*, and the wirings 10*a* from the connector 8*a* to the outside device are all laid through the interior of the mounting pole 2*a*. Therefore, the wirings 10*a* are not exposed to the outside. The wirings 10*a* are connected to the outside device through the interior of the mounting pole 2*a* and the ground to output signals received by the communication device 1*a* outside device or to receive communication signals or power source signals transmitted from the outside. By moving the communication device 1*a* in the direction of an arrow in FIG. 3, the communication device 1*a* can be mounted to the communication device mounting part 9*a* and the connector 7*a* can also be fitted in the connector 8*a* at the same time. This communication device 1*a* is, for example, a simplified portable telephone base station for radio communication.

Figure 4:
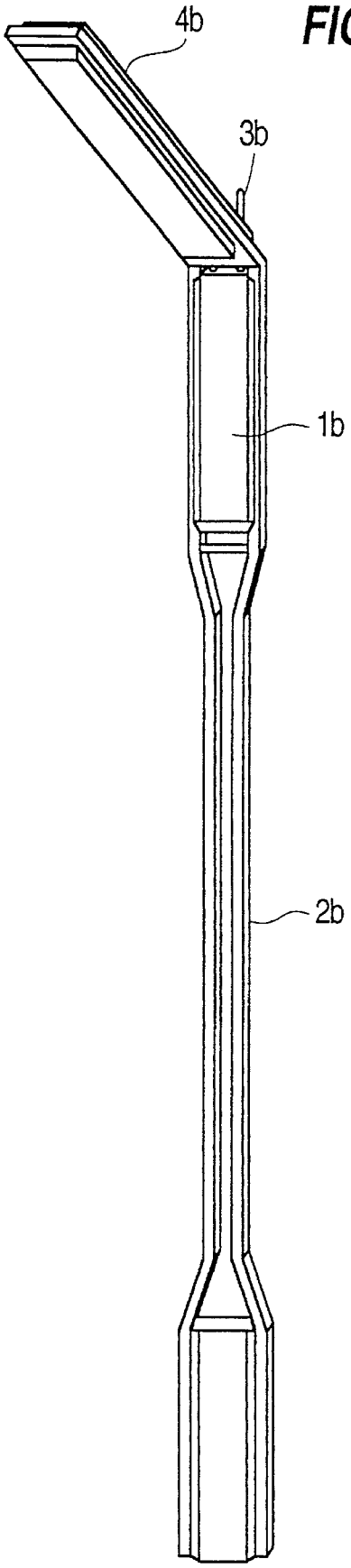
FIG. 4 is a perspective view showing a second embodiment of an installation structure with respect to the outdoor communication device of the present invention.

FIG. 4 is a general perspective view showing a second embodiment of the installation structure with respect to the outdoor communication device of the present invention.

As shown in FIG. 4, according to the present embodiment, since the mounting pole 2*b* has a selfsupported streetlight-like configuration in imitation of a streetlight, with a streetlight unit 4*b* being mounted on the mounting pole 2*b*, the mounting pole 2*b* may accord with the environment. In this case, of course, the communication device 1*b* with an antenna 3*b* is releasably mounted on the mounting pole 2*b*. With reference to the other parts, the present embodiment is constituted in the same way as the first embodiment.

According to the installation structure of each of the above embodiments, the mounting part and the device are connected by means of a connector in such a manner that the communication device can easily be releasably mounted to the mounting part and hence the communication device can be installed in an elevated spot. Therefore, an antenna which needs to be installed in the elevated spot can be mounted directly on the communication device thereby eliminating wirings between the antenna and the outdoor communication device, with a result that signal transmission loss due to wirings is eliminated, and signal loss or transmission loss of the communication device due to the wirings can be reduced.

Figure 5:
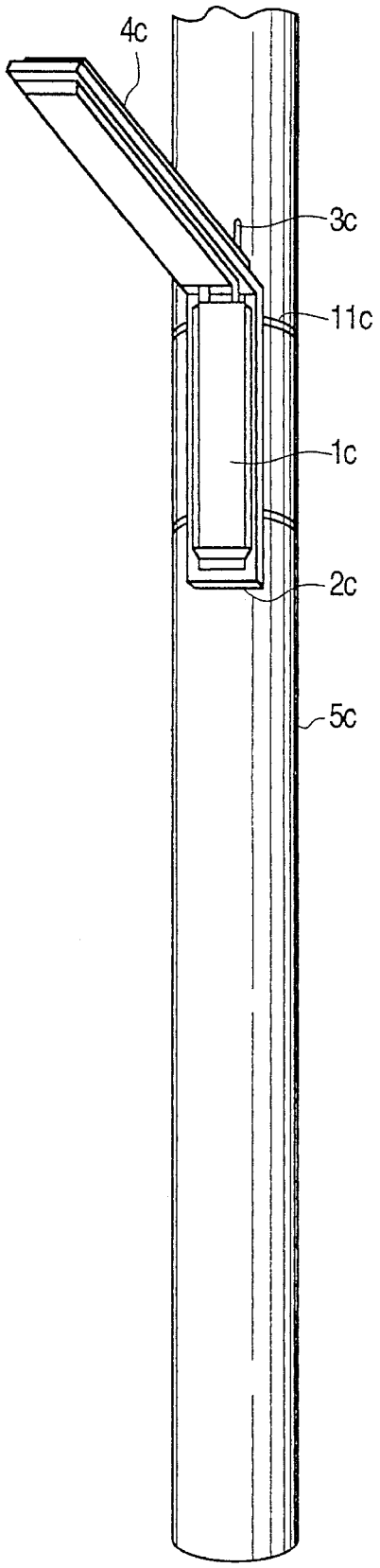
FIG. 5 is a perspective view showing a third embodiment of an installation structure with respect to the outdoor communication device of the present invention.

FIG. 5 is a perspective view of a third embodiment of the installation structure with respect to the outdoor communication device of the present invention.

As shown in FIG. 5, the present embodiment is applicable in the case that an installation space, which is provided in the first and second embodiments, is not available and the communication device needs to be installed on the existing facilities.

That is, a mounting part 2*c* for mounting communication device, a streetlight unit 4*c*, and communication device 1*c* having an antenna 3*c* on its top are formed into a single body and mounted to an existing utility pole or a telephone pole 5*c* by means of a metal fixture 11C in such a manner that these devices take an appearance of an ordinary streetlight. Hence, the installation structure as described above may be integrated into the environment. In the above installation structure, the communication device 1*c* is releasably mounted on the mounting part 2*c* by fitting it into the part 2*c*.

Figure 6:
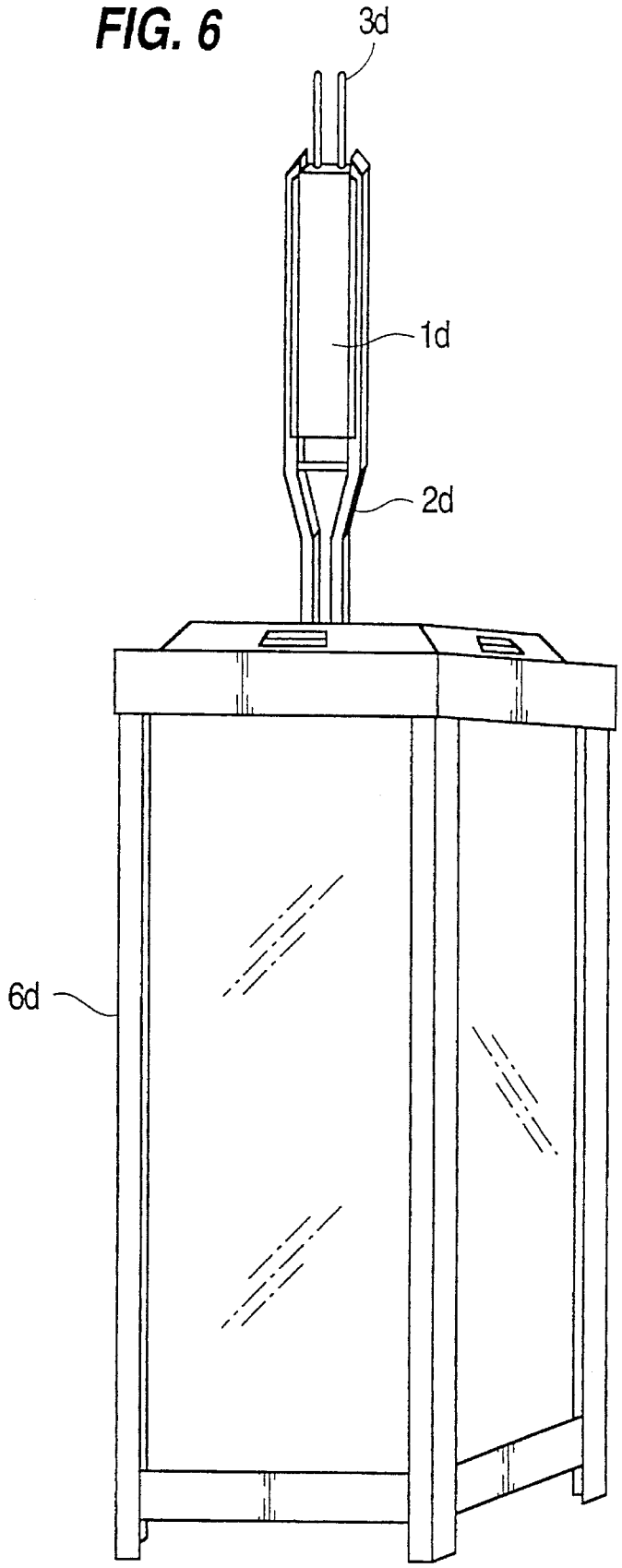
FIG. 6 is a perspective view showing a fourth embodiment of an installation structure with respect to the outdoor communication device of the present invention.

FIG. 6 is a perspective view of a fourth embodiment of the installation structure with respect to the outdoor communication device of the present invention.

As shown in FIG. 6, the installation structure of the present embodiment is arranged such that a mounting part 2*d* in the form of a short pole having thereon a communication device 1*d* having an antenna 3*d* on its top. Top communication device 1*d* is fixed to the top of an existing telephone booth 6*d* so that it may look as if it is a part of the telephone booth 6*d*. The installation structure of the present embodiment includes the mounting part 2*d* and the telephone booth 6*d* which are formed into a single body, so that they can be integrated into the environment. As for other parts, the installation structure is constituted in the same way as the third embodiment.

In the above third and fourth embodiments, the wiring from the mounting part are led to a utility pole or telephone pole and telephone booth respectively and connected to the outside device.

Since the present invention has a constitution as described above, it produces such effects as follows:

Since the present invention has simplified process of mounting and dismounting outdoor communication device on and from a mounting part of a mounting pole by connecting the outdoor communication device and the mounting part through a connector, the outdoor communication device has excellent maintainability and can be installed in an elevated spot. As a result, an antenna can be mounted directry on the communication device, thereby eliminating wirings between the antenna and the outdoor communication device, and hence, the loss of the outdoor communication device is reduced and also damage due to vandalism can be avoided.

Also, according to the present invention, the outdoor communication device is mounted on the top of the mounting pole in the form of a selfsupported pole and wirings are laid in the interior of the mounting pole, or the street light unit is provided on the top of the mounting pole to imitate a street light, and hence the mounting pole can be installed in the street without injuring the beauty of the street, particularly in the street of a concept town, which is constructed in a highly developed manner, without degrading the beauty of the surrounding area.

Further, according to the present invention, since a mounting part is arranged so as to be integrated into the environment by providing the mounting part in imitation of a streetlight, which mounting part is attached to an existing utility pole or a telephone pole or attached onto a telephone booth so as to be integrated thereinto, even when an installation space for the mounting pole cannot be obtained and the outdoor communication device needs to be installed on existing arrangements, it is possible to install the outdoor communication device without spoiling the beauty of the environment.

What is claimed is:

1. An installation structure, comprising:

an outdoor communication device having an antenna on a top portion thereof and having a connector on a bottom portion thereof; and a mounting pole in a form of a selfsupported pole having a communication device mounting part on a top portion thereof, said mounting pole having a hollow interior area in which wirings that are electrically connected to said communication device mounting part are laid therethrough so as to not be exposed to an exterior area with respect to the mounting pole;

wherein said outdoor communication device is electrically connected with said communication device mounting part when said connector is mounted onto said communication device mounting part, and wherein said wirings are electrically connected with said connector when said connector is mounted onto said communication device mounting part.

2. The installation structure according to claim 1, wherein said mounting pole has an upper part and a lower part, and wherein said mounting pole comprises a streetlight unit provided on the upper part.

3. The installation structure according to claim 2, wherein said communication device mounting part includes a groove having a rectangular shape, said connector includes a rectangular nodule on a bottom portion thereof, and wherein said connector is mounted onto said communication device mounting part by inserting said rectangular nodule into said groove.

4. The installation structure according to claim 2, wherein communication device is releasably mounted onto said connector, and wherein said communication device can be removed from said communication device mounting part on said mounting pole by providing an upward force to said communication device.

* * * * *